US005368515A

United States Patent [19]

Mast

[11] Patent Number: 5,368,515

[45] Date of Patent: Nov. 29, 1994

[54] WIND OPERATED SOUND PRODUCING PINWHEEL

[75] Inventor: Richard Mast, Chesterfield, Va.

[73] Assignee: Amuse Me, Inc., Petersburg, Va.

[21] Appl. No.: 178,677

[22] Filed: Jan. 7, 1994

[51] Int. Cl.[5] ..... A63H 33/40; A63H 5/00

[52] U.S. Cl. ..... 446/217; 446/404; 446/415

[58] Field of Search ..... 446/213, 212, 216, 217, 446/218, 397, 404, 405, 406, 407, 409, 414, 415, 418, 419, 420, 421, 422

[56] References Cited

U.S. PATENT DOCUMENTS

| | | | |
|---|---|---|---|
| 333,611 | 1/1886 | Daveggio | 446/213 X |
| 717,489 | 12/1902 | Worden | 446/213 |
| 733,778 | 7/1903 | Weber | 446/218 X |
| 783,714 | 2/1905 | Wunder | 446/213 |
| 1,385,054 | 7/1921 | Sommers | 446/420 |
| 1,890,288 | 12/1932 | Graf | 446/421 |
| 2,532,835 | 12/1950 | Cohn | 446/213 |
| 2,987,850 | 6/1961 | Bergland | 446/404 |
| 3,071,894 | 1/1963 | Frye | 446/404 |
| 3,229,412 | 1/1966 | Golub et al. | 446/217 |
| 3,252,241 | 5/1966 | Gould | 446/217 |
| 5,241,777 | 9/1993 | Looker et al. | 446/217 X |

FOREIGN PATENT DOCUMENTS

| | | | |
|---|---|---|---|
| 87901 | 4/1922 | Austria | 446/217 |
| 133370 | 10/1951 | Switzerland | 446/217 |
| 446390 | 4/1936 | United Kingdom | 446/213 |

*Primary Examiner*—Robert A. Hafer
*Assistant Examiner*—D. Neal Muir
*Attorney, Agent, or Firm*—Herbert Dubno; Andrew Wilford; Yuri Kateshov

[57] ABSTRACT

A pinwheel vibrates a blade extending across an opening provided with an acoustic column to generate sound as the formations on the pinwheel engage the blade.

17 Claims, 2 Drawing Sheets

WIND OPERATED SOUND PRODUCING PINWHEEL

FIELD OF THE INVENTION

My present invention relates to an air or wind-propelled sound-producing device or pinwheel arrangement. More particularly the invention relates to a pinwheel assembly which, upon rotation of the pinwheel, generates a sound.

BACKGROUND OF THE INVENTION

Sound-producing devices which utilize air or wind to generate the sound or to change the character of the sound are known in a variety of configurations. For example, U.S. Pat. No. 3,747,266 discloses a sound-producing device with resonance chambers controlled by the movements of a rod for varying sound emitted from a whistling mouth. A spinner is utilized in U.S. Pat. No. 3,151,866 and a toy windmill and noise-maker is disclosed in U.S. Pat. No. 3,392,481, the latter patent disclosing the use of arcuate drum-sticks which beat upon a metal drum. A pinwheel siren is disclosed in U.S. Pat. No. 3,619,936 in which a rotating member produces a siren sound by vibration of a diaphragm.

Substantially all of the aforedescribed systems are rather complex and, to the extent that a pinwheel is provided, may obstruct the appearance of the pinwheel and render the same less attractive as an eye-catching rotating toy. Furthermore, the sound-generating systems are not always reliable and effective at low wind forces.

OBJECTS OF THE INVENTION

It is, therefore, the principal object of the present invention to provide an improved pinwheel-type of device capable of generating sound without visually obstructing the pinwheel or interfering with its appearance and which is also more reliable than earlier pinwheel-type sound-generating devices.

Another object of the invention is to provide an improved pinwheel-type sound-generating device which is of simple construction, is easy to use, and reliably can produce sounds even with relatively low air or wind velocities past the pinwheel head.

It is also an object of the invention to provide a pinwheel-type of sound-producing device which can be readily assembled, is of low cost and is free from the drawbacks enumerated above.

SUMMARY OF THE INVENTION

These objects and others which will become apparent hereinafter are attained, in accordance with the present invention in a sound-producing wind-propelled device, namely, a pinwheel-type of device which comprises:

a rod;

a head mounted on an end of the rod and defining a journal with an axis generally transverse to the rod;

a pinwheel mounted on the journal for rotation about the axis, the pinwheel having a front and a back, the back of the pinwheel being formed with at least one projection;

a resilient vibratile blade mounted on the head and having a free end engaged by the projection as the pinwheel rotates about the axis for producing a vibrating sound at a frequency determined by a speed of the pinwheel; and an acoustic column formed on the head and having an opening across which the vibratile blade extends, and a tubular formation extending away from the opening generally perpendicular to the blade for enhancing sound production by the vibratile blade.

15 According to one aspect of the invention, the vibratile blade can lie in a plane generally perpendicular to the rod and parallel to the axis of rotation of the pinwheel. In all of the embodiments of the invention, the vibratile blade can be anchored to the head at one side of the opening and can extend diametrically across the opening with a width at least equal to the diameter of the opening.

The head can be molded in one piece with the acoustic column and the formations on the back of the pinwheel can be eyelets at least two of which are provided, preferably equidistantly from the axis.

The blade can be elongated with its longitudinal dimension parallel to the axis of rotation on the head and in another embodiment of the invention this blade can lie in a plane generally parallel to the rod.

In another embodiment of the invention this blade can lie in a plane generally parallel to the rod.

The column can have its axis perpendicular to the axis of rotation of the pinwheel and laterally offset therefrom and the column axis can be parallel or perpendicular to the rod.

The means for attaching the blade to the plate from which the acoustic column projects, can be a pair of split studs projecting into holes of the blade and molded unitarily with the head.

The head can also have a sleeve receiving the rod or molded unitarily therewith and onto which a cap can be snap-fitted.

With the blade being engaged by the eyelets of the pinwheel so as to vibrate it, the blade generates within the acoustic column a vibrating air column which augments the sound production by the device in a simple manner. By varying the dimensions of the acoustic column, the amplitude of the sound produced can be changed and, of course, the frequency of the sound generated is generally a function of the speed of the pinwheel and the number and spinner of the eyelets or formations provided thereon.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 2:
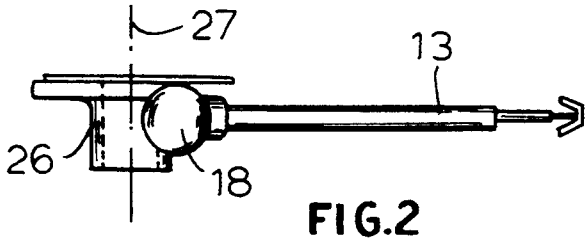
FIG. 2 is a top view of the device.
Figure 3:
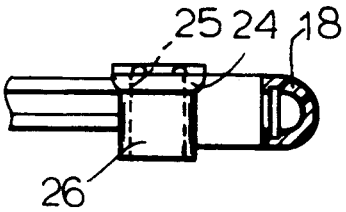
FIG. 3 is a side view of the device rotated in its plane and with the cap shown in section.
Figure 1:
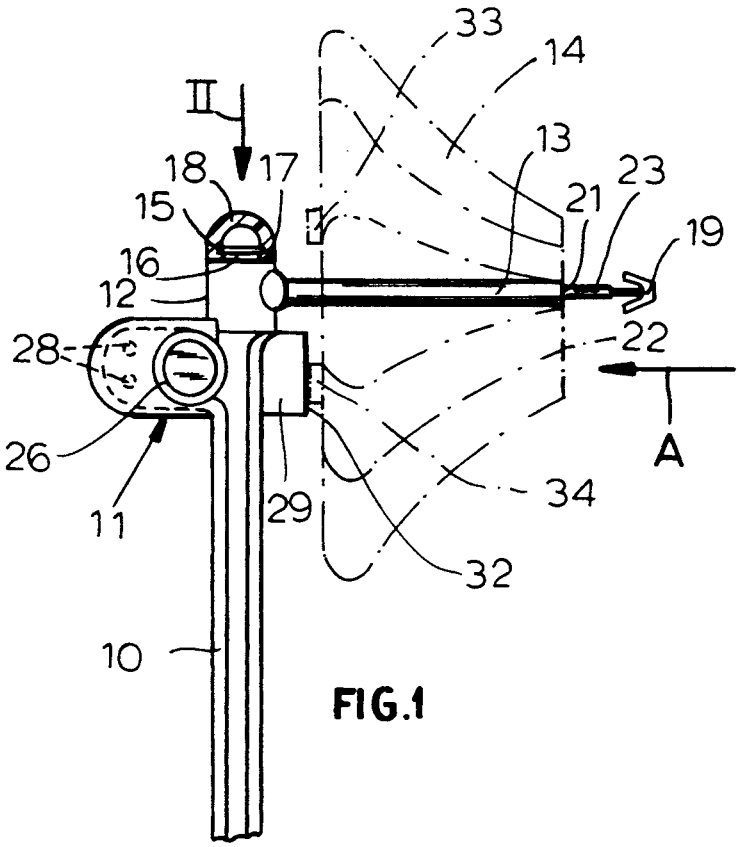
FIG. 1 is an elevational view with the pinwheel shown only in dot-dash lines of a device according to the present invention for generating sound upon being propelled by wind or air movement.
Figure 5:
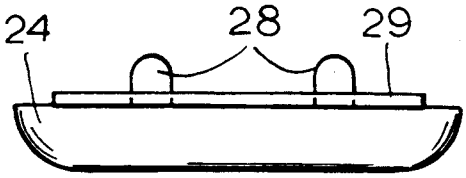
FIG. 5 is an end view of the plate showing the studs thereon.
Figure 6:
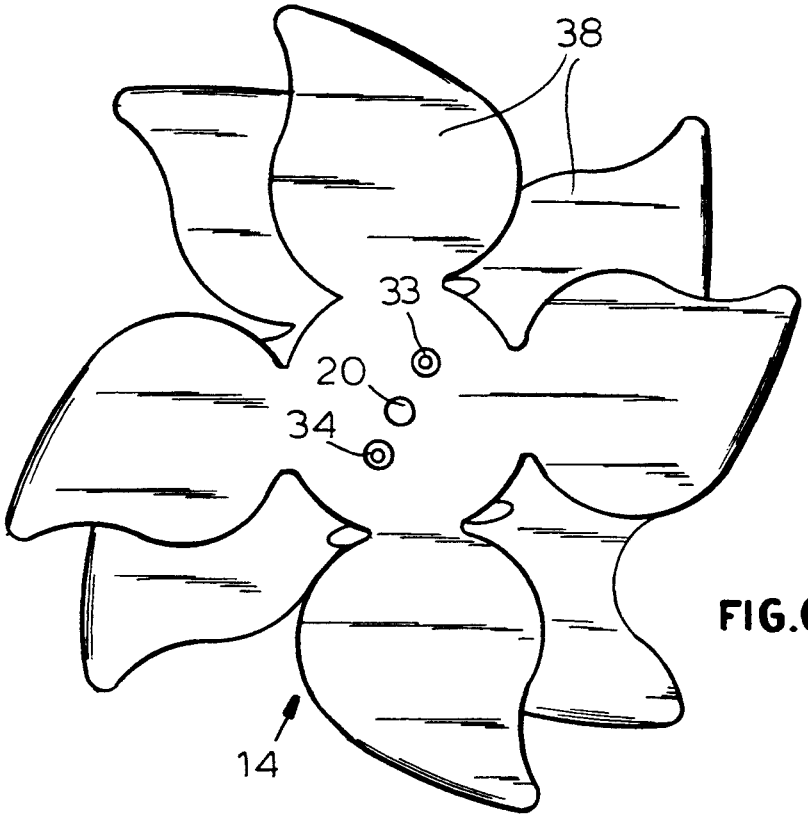
FIG. 6 is a rear view of the pinwheel adapted to be mounted on the pinwheel shaft of the embodiment of FIGS. 1–5.

In FIGS. 1–3, I have shown a pinwheel device in which the rod 10 is molded unitarily with a head 11 or is fitted into a sleeve portion 12 of this head from which a shaft 13 can project laterally to carry the foil pinwheel 14 of conventional design, better seen in FIG. 6 from the rear.

The top of the sleeve or boss 12 can be formed with a ridge 15 above a groove 16 into which a rim 17 of a hemispherical cap 18 can engage with a snap fit.

The shaft 13 is formed with a barb 19 at its free end which prevents the pinwheel 14 from pulling off and over which the holes 20 of the pinwheel can be forced when the pinwheel is mounted on the shaft in the direction of arrow A.

The arrow A also represents the direction in which the wind blows upon the pinwheel 14 to rotate it.

The pinwheel may be prevented from moving too far to the left by a shoulder 21 engaging the front disk 22 of the pinwheel and formed between a small diameter extension 23 of the shaft and the body of the shaft itself.

The head 11 also is molded unitarily with a plate 24 at which a hole 25 opens in registry with a tubular projection 26 forming an acoustic column. In this embodiment, the axis of the acoustic column is represented at 27 and is perpendicular to the rod 10 and to the axis of rotation of the pinwheel 14 defined by the shaft 13.

Figure 4:
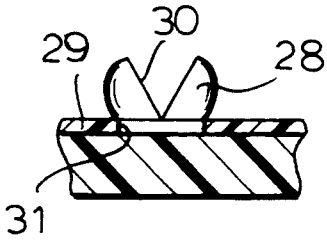
FIG. 4 is a detail view showing the split studs used to held the blade on the plate.
Figure 8:
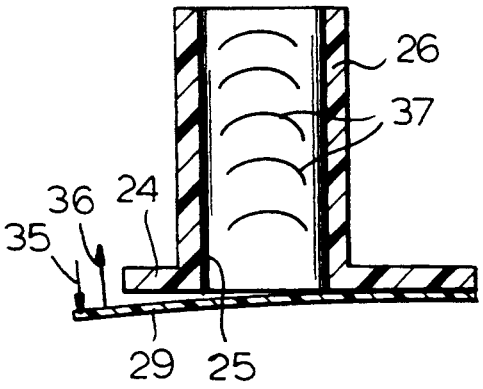
FIG. 8 is a detail section showing a principle of the invention.

The plate 24 is provided with a pair of studs 28 which retains one end of a blade 29 against the plate. The studs may be split as shown at 30 in FIG. 4 to provide a resilient formation over which the holes 31 of the blade 29 can be forced. The blade 29 has a free end 32 which can be engaged by formations 33 and 34 of the pinwheel 14 as these formations swing in the course of rotation of the pinwheel past the free end 32 of the blade. As can be seen from FIG. 8, the engagement of the blade 29 by the formations 33, 34 can deflect the blade in the direction of the arrow 35 so that the blade will spring back in the direction of arrow 36 when the formation passes by to produce a vibration of the blade against the plate 24 and thus generate sound waves represented at 37 in the column 26, constituting the sound emitted by the pinwheel device.

The formations 33 and 34 are eyelets as can be seen from FIG. 6 which also illustrates the leaflets or vanes 38 of the pinwheel which can be reflective or can be provided with a variety of colors affording an aesthetic visual display upon rotation of the pinwheel.

Figure 7:
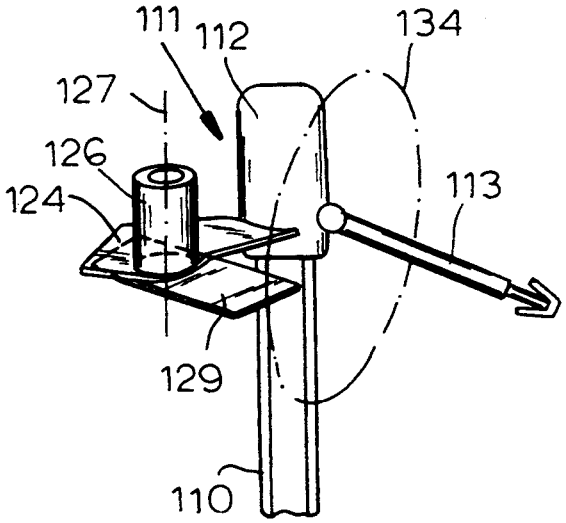
FIG. 7 is a perspective view of another embodiment.

In the embodiment illustrated in FIG. 7, the head 111 has a sleeve 112 receiving the rod 110 and formed with the shaft 113 about which the pinwheel rotates with an orbit of its formations as represented by the dot-dash line 134. In this embodiment, the plate 124 lies in a plane perpendicular to the rod 110 and carries the acoustic cylinder 126 while the vibratile element is a blade 129 which lies in a plane perpendicular to the rod 110 and parallel to the shaft 113. In both embodiments the longitudinal dimension of the blade 29, 129 is parallel to the shaft 113. Here the axis 127 of the acoustic cylinder is parallel to the rod 110 and perpendicular to the shaft 113. The pinwheel 14 can be used in this embodiment as well. The vibration of the blade and the generation of sound waves thereby is otherwise the same as in the embodiment of FIGS. 1–6.

I claim:

1. A sound-producing wind-propelled device, comprising:

a rod;

a head mounted on an end of the rod and formed with a plate and defining a journal with a journal axis generally transverse to the rod;

a pinwheel mounted on the journal for rotation about the journal axis, the pinwheel having a front and a back, the back of the pinwheel being formed with at least one projection;

a resilient vibratile elongated blade mounted on the head and having a free end engageable by the at least one projection as the pinwheel rotates about the axis for producing a vibrating sound at a frequency determined by a speed of the pinwheel, the blade lying in a plane generally parallel to the rod, and extending generally parallel to the journal axis; and a cylindrical tubular formation on the plate forming an acoustic column adjacent the head and having an opening in the plate and the cylindrical tubular formation across which the vibratile blade extends, the column extending perpendicularly to the plate at one side thereof, an opposite side of the plate being formed with a pair of studs unitary with the plate and snap-fitted into the blade to secure the blade against the plate over the opening, the column having a column axis perpendicular to the journal axis and to a rod axis of the rod and being laterally offset from the journal axis and the rod.

2. The sound-producing wind-propelled device defined in claim 1 wherein said vibratile blade is anchored to said head at one side of said opening and extends diametrically across said opening.

3. The sound-producing wind-propelled device defined in claim 2 wherein said vibratile blade has a width at least equal to a diameter of said opening.

4. The sound-producing wind-propelled device defined in claim 3 wherein said head is molded in one piece with said acoustic column.

5. The sound-producing wind-propelled device defined in claim 1 wherein said back of said pinwheel has at least two of said projections extending toward the head.

6. The sound-producing wind-propelled device defined in claim 1 wherein said projections are eyelets.

7. The sound-producing wind-propelled device defined in claim 6 wherein said journal is provided with a shaft upon which said pinwheel is rotatable, said shaft having a free end formed with a barb engageable in said pinwheel.

8. The sound-producing wind-propelled device defined in claim 7 wherein said blade is elongated and extends generally parallel to said axis on said head.

9. The sound-producing wind-propelled device defined in claim 1 wherein said studs are split.

10. The sound-producing wind-propelled device defined in claim 1 wherein said head has a tubular formation receiving said rod and provided with a cap snap-fitted thereon.

11. A sound-producing wind-propelled device, comprising:

a rod;

a head mounted on an end of the rod and defining a journal with a journal axis generally transverse to the rod;

a pinwheel mounted on the journal for rotation about the journal axis, the pinwheel having a front and a back, the back of the pinwheel being formed with at least one projection;

a resilient vibratile elongated blade mounted on the head and having a free end engageable by the at least one projection as the pinwheel rotates about the axis for producing a vibrating sound at a frequency determined by a speed of the pinwheel, the vibratile blade lying in a plane generally parallel to the rod and extending generally parallel to the journal axis; and an acoustic column formed adjacent the head and having an opening across which the vibratile blade extends, the column having a column axis orthogonal to the journal axis and to the rod, the column being laterally offset from the journal axis and the rod, the column being defined by a cylindrical tubular formation extending away from the opening generally perpendicular to the blade for enhancing sound production by the vibratile blade.

12. The sound-producing wind-propelled device defined in claim 11 wherein said head is formed with a plate defining said opening, said column extending perpendicularly to said plate at one side thereof, an opposite side of said plate being formed with a pair of studs unitary with said plate and snap-fitted into said blade to secure said blade against said plate over said opening.

13. A sound-producing wind-propelled device, comprising:

a rod;

a head mounted on an end of the rod and formed with a plate and defining a journal with a journal axis generally transverse to the rod;

a pinwheel mounted on the journal for rotation about the journal axis, the pinwheel having a front and a back, the back of the pinwheel being formed with at least one projection;

a resilient vibratile elongated blade mounted on the head and having a free end engageable by the projection formation the pinwheel rotates about the axis for producing a vibrating sound at a frequency determined by a speed of the pinwheel, said vibratile blade lying in a plane generally perpendicular to said rod and extending generally parallel to the journal axis; and a cylindrical tubular formation on the plate forming an acoustic column formed on the head and having an opening in the plate and the cylindrical tubular formation across which the vibratile blade extends, the column extending perpendicularly to the plate at one side thereof, an opposite side of the plate being formed with a pair of studs unitary with the plate where the blade is snap-fitted onto the plate to secure the blade against the plate over the opening, the column having a column axis perpendicular to the journal axis and parallel to the rod and being laterally offset therefrom.

14. The sound-producing wind-propelled device defined in claim 13 wherein said vibratile blade is anchored to said head at one side of said opening and extends diametrically across said opening.

15. The sound-producing wind-propelled device defined in claim 13 wherein said vibratile blade has a width at least equal to a diameter of said opening.

16. The sound-producing wind-propelled device defined in claim 13 wherein said head is molded in one piece with said acoustic column.

17. The sound-producing wind-propelled device defined in claim 13 wherein said back of said pinwheel has at least two of said projections extending toward said head, said projections being eyelets.

* * * * *